United States Patent [19]

Sano et al.

[11] Patent Number: 4,666,590

[45] Date of Patent: May 19, 1987

[54] YARN-THREADING METHOD AND DEVICE

[75] Inventors: Takao Sano, Otsu; Toshihide Sekido, Kyoto; Masafumi Ogasawara, Otsu, all of Japan

[73] Assignee: Toray Industries, Inc., Tokyo, Japan

[21] Appl. No.: 860,751

[22] Filed: May 2, 1986

Related U.S. Application Data

[62] Division of Ser. No. 681,821, Dec. 14, 1984, abandoned.

[30] Foreign Application Priority Data

Dec. 15, 1983 [JP] Japan ..... 58-235181
Dec. 23, 1983 [JP] Japan ..... 58-197075

[51] Int. Cl.[4] ..... B01D 33/00

[52] U.S. Cl. ..... 209/2; 210/251; 210/350; 210/360.1; 210/386; 210/541; 210/542

[58] Field of Search ..... 226/100, 97; 242/18 R, 242/18 PW, 18 A, 18 DD, 35.5 A, 1; 209/1, 2, 10; 210/251, 350, 360.1, 386, 541, 542, 770; 110/104, 116, 131, 145, 150, 179, 183, 184, 214, 215, 226, 299

[56] References Cited

U.S. PATENT DOCUMENTS

| | | | |
|---|---|---|---|
| 3,423,000 | 1/1969 | Heinen | 226/97 |
| 3,690,530 | 9/1972 | Porter | 226/97 |
| 3,718,270 | 2/1973 | Parmeggiani et al. | 226/97 |
| 3,741,050 | 6/1973 | Coats et al. | 83/22 |

*Primary Examiner*—Frank Sever
*Attorney, Agent, or Firm*—Birch, Stewart, Kolasch & Birch

[57] ABSTRACT

A yarn-threading method and device wherein a suction gun being fed with a pressurized liquid jet of not less than 80 kg/cm$^2$G is placed next to a running yarn; the yarn is attracted and taken into a yarn-guide hole of said suction gun, producing a state of attracting the yarn running at a speed of not less than 4,500 m/min.; and with this state of the yarn being maintained, the suction gun is moved to thread the attracted yarn on a winder means rotating at a speed of not less than 4,500 m/min.

9 Claims, 32 Drawing Figures

YARN-THREADING METHOD AND DEVICE

This application is a divisional of copending application Ser. No. 681,821, filed on Dec. 14, 1984, now abandoned.

BACKGROUND OF THE INVENTION

1. Field of the invention

The present invention relates to a yarn-threading method and device by which a running yarn can be drawn and held at fast speed and the yarn thus drawn and held can be threaded on high-speed rotating or moving means for feeding or receiving a yarn such as a high-speed rotating godet roller in a spinning process or a high-speed rotating bobbin in a winding process. The rotating or moving means for feeding or receiving a yarn may be reffered to as a winder means hereafter.

2. Description of the prior art

It is well-known that a movable suction gun is available for the purpose of catching a running yarn and threading it on a rotating or a moving means, say, a godet roller, a winder bobbin or a yarn guide. It is also well-known that pressurized air or water is used as a working fluid by which a yarn is drawn into a suction gun.

Lately, with the progress of technology, a high-speed winder that handles a yarn at a rate of 4,500 m/min. has been developed for practical application.

In such a high-speed yarn-handling device a movable suction gun that can thread a yarn on a yarn-handling element with a peripheral speed exceeding 4,500 m/min. such as a godet roller or a winder bobbin should be able to draw the yarn at a speed of not less than 4,500 m/min. and be able to maintain this state of suction continuously.

The yarn-sucking speed available from the conventional movable suction gun, however, is at most 4,000 m/min. and this speed is widely accepted in the industry. Thus, for the introduction of said high-speed winder in the industry the rotating speed of the yarn-handling element has to be slowed down to a speed of less than 4,000 m/min. so that the conventional suction gun can catch the running yarn, and after threading, the high-speed yarn-handling element goes into full operation at regular speed. This may be one mode of threading with the use of the conventional suction gun but in this mode the available high-speed is not fully used and the superior high-speed winder cannot display its full performance. Hence a demand has developed for the development of a movable yarn-threading suction gun with a sucking speed exceeding 4,500 m/min.

As described in detail hereinafter, according to the present invention a liquid (specifically water) is employed as the working fluid of the suction gun. Japanese Utility Model Publication No. SH051-28424 discloses use of water as the working fluid of a suction gun. In this publication it is stated that the purpose of enhancing the yarn drawing power the liquid pressure may be increased, but the increase of the liquid pressure is not a practical solution, because it will also produce an increased impact on the yarn, thereby breaking the yarn.

By way of checking this point, the present inventors made an experiment in which a suction gun using pressurized water of 80 kg/cm$^2$G as the working fluid was used to draw and thread the yarn on a godet roller having a peripheral speed of 4,500 m/min. and a suction gun using pressurized water of 100 kg/cm$^2$G as a working fluid was adopted to draw and thread the yarn on a godet roller having a peripheral speed of 5,000 m/min. The threading turned out to be unexpectedly successful without any breaking of the yarn despite the extremely high pressure of the water.

SUMMARY OF THE INVENTION

An object of the present invention is to provide a technique satisfying the above-mentioned demand, i.e., a method and device for threading the yarn on a yarn winder means with a peripheral speed of 4,500 m/min., using a movable suction gun.

The yarn-threading method according to the present invention is as follows: A suction gun supplied with a pressurized liquid of 80 kg/cm$^2$G is brought up to a running yarn. The yarn is drawn into a yarn-guide hole of the suction gun, whereby the state where the running speed of the yarn is held not less than 4,500 m/min. is produced. With this state of suction maintained, the suction gun is moved to thread the sucked yarn on a yarn winder means rotating at a peripheral speed of not less than 4,500 m/min.

A yarn-threading device according to the present invention to realize the above method comprises: a movable yarn-sucking suction gun employing a pressurized liquid of not less than 80 kg/cm$^2$G as a working fluid; a waste disposal tank which separates the drawn yarn from the liquid, both being ejected at the same time from the suction gun; a storage tank which holds the liquid separated in the waste disposal tank; and a high-pressure pump which supplies the liquid in the storage tank to the suction gun as a pressurized liquid of 80kg/cm$^2$G.

Another yarn-threading device according to the present invention utilizes a movable suction gun using a pressurized liquid of not less than 80 kg/cm$^2$G as a working fluid. The suction gun is equipped with not less than two suction nozzles and the axes of the suction nozzles converge to a single point.

Another yarn-threading device according to the present invention is one having a suction gun comprising a fluid ejection nozzle for ejecting a fluid and a discharge pipe for discharging both the fluid together with the yarn, an ejection hole of the fluid ejection nozzle and a guide hole of the discharge pipe being spaced opposed to each other and the fluid being a pressurized liquid of not less than 80kg/cm$^2$G in pressure, and the relationship between the bore diameter (d) of the fluid ejection hole and the bore diameter (D) of the discharge pipe being as follows:

$$1.25d < D < 4.5d.$$

Another yarn threading device according to the present invention is one wherein a suction gun having a suction mechanism consisting of a mechanism for the ejection of a pressurized liquid is located near a winder means.

The device constituted as described above was tested under various conditions and it has been discovered that favorable conditions to attain the purpose can be determined by using mathematical formulas.

Now it is experimentally verified that for the purpose of minimizing the hazard of the yarn being broken in the threading process it is desirable to have the following relation satisfied:

$$V_1/V_0 = 0.5 - 0.6 \quad \text{(a)}$$

where $V_0$(m/min.) is the flow velocity of the pressurized liquid as it is ejected from the suction nozzles in the suction gun and $V_1$(m/min.) is the peripheral speed of the rotating yarn winder means.

Now assuming the nozzle exit pressure to be equal to the atmospheric pressure, $V_o$ will be given according to the relationship $$V_0 = 60 \cdot \sqrt{2g \times P_0 \times 10^4} / \gamma (\text{m/min.}) \quad \text{(b)}$$

where g: acceleration of gravity (=9.8 m/sec$^2$)

$\gamma$: specific gravity of the liquid (kg/m$^3$)

$P_0$: liquid pressure (gauge pressure) (kg/cm$^2$)

Putting $C_D = V_1/V_0$, the following is derived from (a):

$$0.5 < C_D < 0.6 \quad \text{(c)}$$

and from (b) the following is derived;

$$P_0 = (V_1/C_D)^2 \gamma / (60^2 \times 2g \times 10^4) \quad \text{(d)}$$

Then the favourable conditions minimizing the hazard of the yarn being broken during the threading operation due to the insufficiency of the drawing force will be experimentally given in terms of $P_0$ as follows:

$$P_0 \geqq (V_1/C_D)^2 \gamma / (60^2 \times 2g \times 10^4) \quad \text{(e)}$$

And the breaking of the yarn due to excessive drawing force of the suction gun will be caused when the pressure of the fluid of the suction gun becomes not less than twice the pressure culculated by (e). Therefore the following is derived:

$$2(V_1/C_D)^2 \gamma / (60^2 \times 2g \times 10^4) > P_0 \geqq (V_1/C_D)^2 / (60^2 \times 2g \times 10^4) \quad \text{(f)}$$

If $C_D = 0.5$ of (c) is substituted into the left extreme of (f) and $C_D = 0.6$ of (c) is substituted into the right extreme of (f), the preferable relation for the present invention between $P_0$ and $V_1$ will be:

$$2(V_1/0.5)^2 \gamma / (60^2 \times 2g \times 10^4) > P_0 \geqq (V_1/0.6)^2 \gamma / (60^2 \times 2g \times 10^4) \quad \text{(g)}$$

The formula (g) is an evolution from the empirical formula (a) and the condition $P_0 = 80$ kg/cm$^2$G will satisfy (g) when $V_1 = 4{,}500$ m/min.

BRIEF DESCRIPTION OF THE DRAWINGS

The above and other objects, features and advantages of the present invention will become apparent and more readily appreciated from the following detailed description of exemplary embodiments of the present invention, taken in conjunction with the accompanying drawings, wherein.

DETAILED DESCRIPTION OF THE PREFERRED EMBODIMENTS

Preferred embodiments of the present invention will be illustrated by referring to the attached drawings. Hereafter the term "yarn-attracting force" refers to a force with which a yarn is attracted to a yarn-guide hole at the tip of a guide pipe of a suction gun. Also the term "yarn-sucking force" refers to a force with which a pressurized fluid entrains a yarn in a suction gun.

Figure 1:
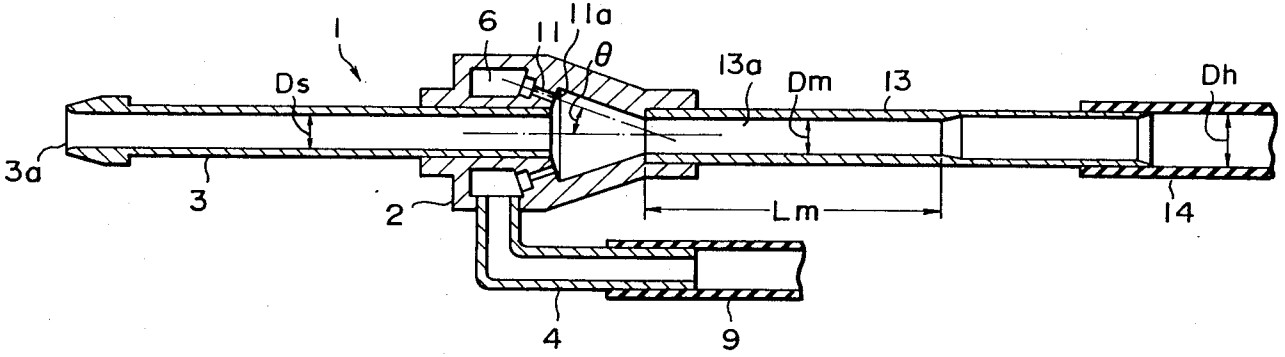
FIG. 1 is a sectional view of a suction gun of one embodiment according to a yarn-threading device of the present invention.

FIG. 1 illustrates a suction gun to be used for threading of a yarn Y according to the present invention. A suction gun 1 is equipped with a yarn guide pipe 3 at the front portion of its gun body 2 and the yarn guide hole 3*a* is disposed at the tip of the yarn guide pipe 3. At the mid-section of the gun body 2 of the suction gun 1 there is located a charge pipe 4 connected to a fluid supply hose 9 for force-feeding a pressurized liquid at not less than 80 kg/cm$^2$G. The charge pipe 4 communicates with a pressurized liquid chamber 6 disposed in the gun body 2. The pressurized liquid chamber 6 in the gun body 2 has not less than two suction nozzles 11 positioned around the rear end of the guide pipe 3, thereby constituting a liquid ejection mechanism. The suction nozzles 11 consist of a plurality of orifices annularly arranged at the liquid chamber 6. At the rear end of the gun body 2 is installed a discharge pipe 13, to which is connected a discharge hose 14.

Suction of a running yarn by the suction gun 1 takes place as follows. First the fluid supply hose 9 supplies a pressurized liquid at not less than 80 kg/cm$^2$G, which is ejected from the suction nozzle 11 provided at the pressurized liquid chamber 6. The water jet effect of ejecting the pressurized liquid produces a velocity of not less than 4,500 m/min. to the running yarn, whereby the yarn is forcibly sucked into the discharge hose 14 together with the pressurized liquid.

Figure 2:
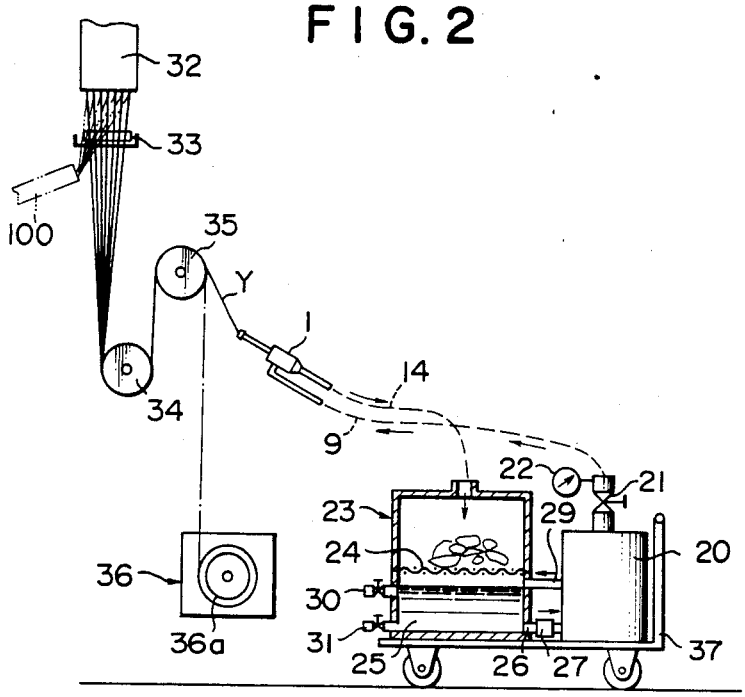
FIG. 2 is an elevational view of one embodiment of a yarn-threading device according to the present invention.

As indicated in FIG. 2, the supply hose 9 for the pressurized liquid is connected via a pressure control valve 21 to a high-pressure pump 20. The pressure control valve 21 serves to set the necessary pressure and by the function of the pressure control valve 21 the pressure with which to supply the liquid forcibly to the supply hose 9 can be arbitrarily changed. Numeral 22 is a pressure gauge, which permits confirmation of a pressure setting. Meanwhile the discharge hose 14 communicates to a waste disposal tank 23, which is equipped internally at its mid-section with a net 24, thereby constituting a storage tank 25 below. A mixture of the working fluid and the yarn coming from the discharge hose 9 is separated from each other by the net 24 and the separated liquid flows down into the storage tank 25.

The liquid which has dropped into the storage tank 25 is drawn via a transport pipe 26 and a filter 27 into the high-pressure pump 20, to be forcibly fed again via the supply hose 9 to the suction gun at a pressure of not less than 80 kg/cm$^2$G. Thereby an overflow of the liquid due to a throttling by the pressure control valve 21 returns via the transport pipe 29 to the storage tank 25.

In this manner the liquid in the storage tank 25, circulating from the high-pressure pump 20 to the suction gun 1 and the waste disposal tank 23, can be utilized as a suction for the yarn. Numeral 30 is a charge hole for initial feed of the liquid to the circulation system and numeral 31 is a discharge hole for final discharge of the liquid. In the circulation of the liquid from the storage tank 25, the entire portion of the liquid may be circulated, or the liquid may be partially charged or partially discharged through said holes 30 and 31 with partial renewal of the liquid. Alternatively, the liquid separated in the waste disposal tank 23 may be totally discarded without being recycled and a fresh liquid may be supplied from a separate storage tank, from which the liquid is fed to a high-pressure pump.

Figure 7:
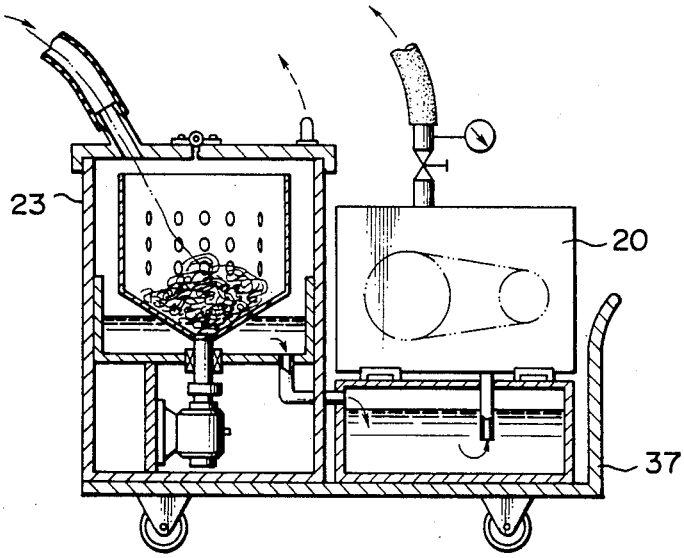
FIG. 7 is a sectional view of dewatering machine mounted on a movable truck.

According to FIGS. 2 and 7, the high-pressure pump 20 and the waste disposal tank 23 are mounted on a movable truck 37 and can be transferred to any location. It may be arranged such that only one or the other is mounted on the truck 37. Mounting on the truck 37 is not always necessary, but the truck-mounting arrangement will permit a single suction gun to serve a spinning machine with multiple spindles and will render the threading process more efficient.

In FIG. 2, numeral 32 denotes a spinning head of a high-speed melting spinner, below which come a lubricator 33, godet rollers 34, 35 and a winder 36. For threading of the yarn in this melt spinning process, the initial yarn Y issuing from the spinning head 32 is drawn into the aspirator 100; then the yarn, while being attracted to a yarn-guide hole 3*a* of the suction gun 1, is run around the godet rollers 34, 35 and finally it is wound on a bobbin 36*a* of the winder 36.

The suction gun 1 is designed to attract the yarn using a pressurized liquid of not less than 80 kg/cm$^2$G as a working fluid. As a working fluid, water has been found to be the most desirable on account of its inertness to the yarn and its availability at low cost. The suction gun 1 according to the present invention which employs a pressurized liquid of not less than 80 kg/cm$^2$G as the working fluid possesses a strong yarn-sucking force with a tremendous attraction. Therefore, when threading on godet rollers with a peripheral speed of not less than 4,500 m/min. is achieved by means of the suction gun 1, a fast running yarn with a speed corresponding to the peripheral speed of the godet rollers will maintain a strong tension in the thread, thereby ensuring an extremely stable threading operation.

Since the liquid is non-compressible, depending on the design of the suction gun 1 the jet of the liquid ejected from the suction nozzle 11 of the pressurized liquid chamber 6 alone may be insufficient to create the high vacuum needed to draw the initial yarn into the yarn-guide hole 3*a*. In such a case an auxiliary mechanism, separate from the suction mechanism created by the fluid jet, may well be installed at the front position of the suction gun 1 to promote the attraction of the initial yarn.

Pressurized liquid for the suction gun 1 can be obtained by a high-pressure pump driven by a motor having a relatively low power capacity. On account of the working fluid being a non-compressible liquid, the threading can take place with extreme quietness of less than 80 db.

Figure 3:
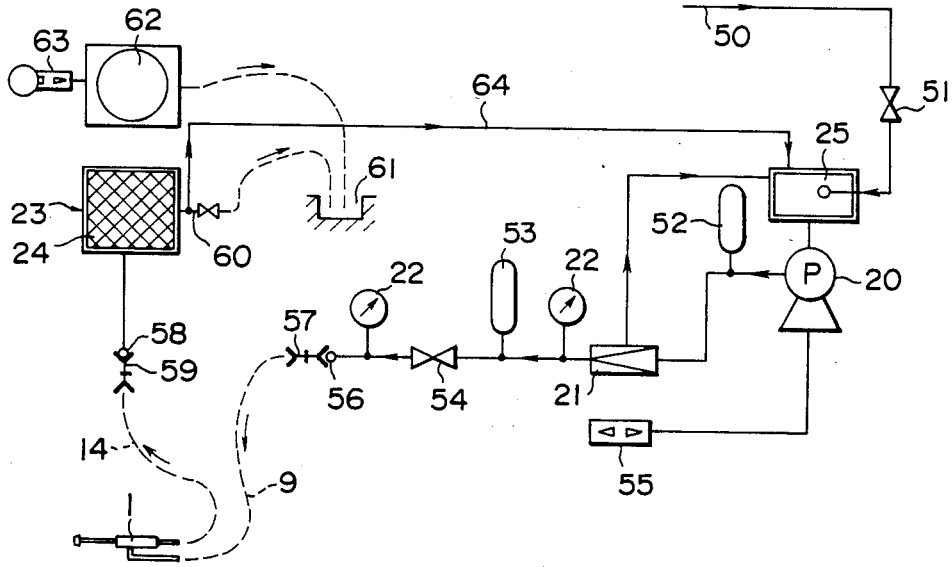
FIG. 3 is a circuit diagram of the device of FIG. 2.

FIG. 3 illustrates another embodiment of the pressurized liquid supply system for the suction gun.

In the system of FIG. 3, the supply hose 9 for the suction gun 1 is designed to be freely attached or detached via a one-touch coupling 57 to the supply end 56, while the discharge hose 14 is designed to be freely attached or detached via a one-touch coupling 59 to the supply end 58 of the waste disposal tank 23.

The liquid (water) separated in the waste disposal tank 23 can be discharged via a discharge pipe 60 into a pit 61 and at the same time can be sent via a transport pipe 64 to the storage tank 25, to be recirculated for use just as in the embodiment of FIG. 2.

Figure 4:
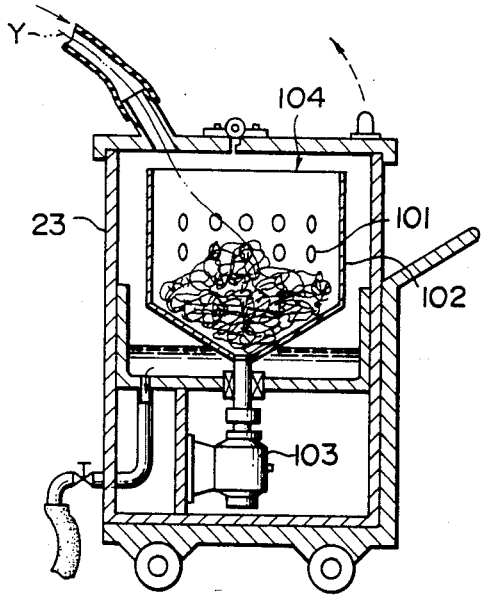
FIG. 4 is a sectional view of a waste disposal tank.
Figure 5:
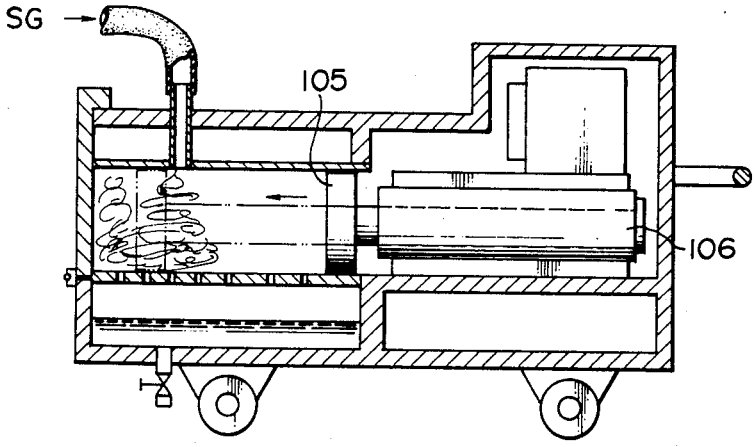
FIG. 5 is a sectional view of a dewatering machine.
Figure 6:
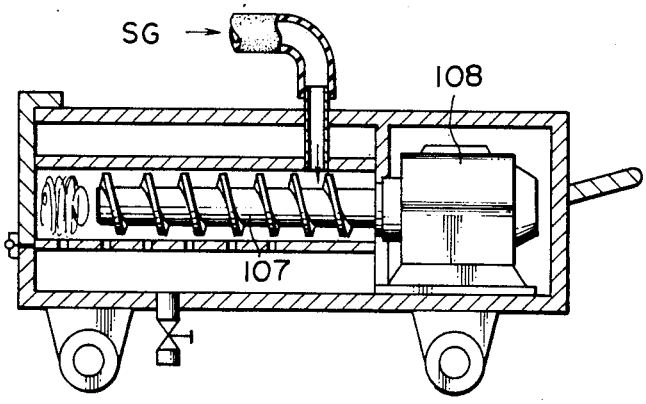
FIG. 6 is a sectional view of another dewatering machine.

Meanwhile the yarn separated in the waste disposal tank 23 is sent to a dewatering machine 62 for dewatering and the separated water, after dewatering, is discharged into the pit 61. The dewatering machine 62 is set in an on or off position by a switch 63. In this embodiment the waste disposal tank 23 and the dewatering machine 62 are designed as independent units, but the two may be integrated as illustrated in FIGS. 4,5 and 6. As the dewatering machine, a centrifugal dewatering machine with rotatable vessel 102 with a plurality of holes 101 rotated by a motor 103 may be adopted as illustrated in FIG. 4; or as illustrated in FIG. 5, the dewatering operation may be accomplished utilizing the squeezing obtained by a compression plate 105 which is focibly moved by a cylinder 106; or as illustrated in FIG. 6, a screw 107 driven by a motor 108 may be employed to dewater the yarn by rotating and compressing it.

As indicated in FIG. 3, to the liquid supply side of the storage tank 25 is connected via a valve 51 a transport pipe 50 for supplying water to the storage tank 25. Water for the storage tank 25 is forcibly fed from the high-pressure pump 20 and, after the pressure is made even at the accumulator 52, it is adjusted to a specified pressure by the pressure control valve 21. The water passing through the pressure control valve 21 is further adjusted, if necessary, by the accumulator 53 before it reaches the valve 54. The water which overflows due to throttling at the pressure control valve 21 is recirculated to the storage tank 25. The high-pressure pump 20 is designed for on-off remote control by the switch 55.

This system just like the one in FIG. 2, which can circulate the pressurized liquid, is also effective in the use of a pressurized liquid.

For instance, high-speed melt spinning of nylon filament 40D-10fx8 yarns at 5,500 m/min. was achieved using the suction gun 1 as illustrated in FIG. 1 for threading. The working fluid was water and the high-pressure pump has a capacity of 22 kwH.

The initial yarn was reliably sucked or drawn by an auxiliary ejector mechanism and with a high tension maintained by the pressurized water of 200 kg/cm$^2$, the threading could be done with very high stability. Noise caused by the threading operation, estimated at less than 80 db, was not offensive to the ear.

As understood from the above example, according to the present invention in which a running yarn can be threaded by a movable suction gun which attracts and turns the yarn, a yarn running at a speed of not less than 4,500 m/min. which cannot be achieved by the conventional suction guns can be threaded with stability, because the working fluid employed is a pressurized liquid of not less than 80 kg/cm$^2$G which yields a higher suction force than the conventional suction gun. Also, the noise generation is low because the working fluid is a non-compressible liquid.

The system with which to execute the threading operation according to the present invention can effectively attain the purpose, because in this system the waste yarn can be easily disposed of in the waste disposal tank in which the liquid-yarn mixture coming out of the suction gun is separated and the separated liquid can be pressurized again for recycling by the high-pressure pump.

Next, various embodiments of the suction gun 1 are to be described. First the suction nozzle 11 will be discussed.

Not less than two suction nozzles 11 are provided and, as indicated in FIG. 1, the axes of these suction nozzles 11 are designed to converge on one point. If the jets issuing from the suction nozzles 11 do not converge on one point, the yarn suction effect will deteriorate.

The suction nozzles 11 are constructed such that the axial extension of the suction nozzle 11 and the axial extension of the discharge pipe 13 intersect at an angle of not more than 45° and that the following relationships (a)–(c) exist wherein n is the number of the suction nozzles 11, d is the bore diameter of the suction nozzle 11, $D_m$ is the bore diameter of the narrowest part of the discharge pipe 13, $L_m$ is the length of the discharge pipe, and $D_h$ is the bore diameter of the discharge hose 14;

$$\sqrt{3n} \cdot d < \sqrt{2} \cdot D_m < 2\sqrt{10n} \cdot d \quad \text{(a)}$$

$$L_m/D_m > 20 \quad \text{(b)}$$

$$2\sqrt{n} \cdot d < D_h. \quad \text{(c)}$$

In the above structure the suction nozzles 11 are not limited to an equi-interval or identical circumferential arrangement. The nozzle section is not limited to a circle. The nozzle tip may be formed so as to be tapered.

Next, the grounds for selecting the intersecting angle 45° and establishing the relations (a), (b), (c) are explained.

In order to reduce the energy loss suffered at the collision between the water jets, it is necessary to minimize the angle of the jet from each suction nozzle 11. In other words, the angle $\theta$ formed at the axial extension of the suction nozzle 11 and the axial extension of the discharge pipe 13 must be minimized. It has been established that an angle where $\theta=45°$ is the allowable upper limit from the view point of the energy loss of the water jet and its attraction effect.

Though the working fluid is a non-compressible liquid, the jet issuing from the suction nozzle 11 will expand slightly in a vertical direction to the jet axis immediately after it exits from the nozzle tip. And since the jets from a plurality of the suction nozzles 11 converge into a single jet, it is obvious that the sectional area of the resultant single jet will be larger than the total sectional areas of these jets before convergence. Thus the sectional area of a jet from the suction nozzles 11 is always larger than the total areas of each sectional area of the jet within the suction nozzle before ejection. Therefore if the discharge pipe 13 for discharging the jet from the suction nozzle 11 has at any place a sectional area which is not as wide as the sectional area of an expanded jet, the jet will flow backward.

To prevent such a backflow, the bore of the discharge pipe 13 has only to be enlarged. Too wide a bore, however, will decrease the occupancy rate of the jet within the discharge pipe 13, leading to a decrease in the wet area of the yarn with the jet, hence to a decrease in yarn drawing force. For this reason the bore diameter of the discharge pipe 13 must be appropriately selected referring to the sectional area of the jet, or the sectional area of the suction nozzle 11. The discharge pipe 13 is generally designed as a multi-stage pipe rather than a simple straight pipe and, it is usually constructed like a diffuser with a gradual enlargement of the diameter. Accordingly the appropriate dimension of the discharge pipe 13 refers to the bore diameter Dm of the narrowest portion 13*a* of the discharge pipe 13 and the value of Dm will be decided in relation to the total sectional area of the suction nozzles 11, making the relationship (a) hold true.

A plurality of jets issuing from the suction nozzles 11 will converge into a single jet, but the suction energy after convergence will be considerably less than the potential energy before ejection due to a considerable energy loss suffered at the collision of the jets.

The yarn-suction force F with which the yarn is drawn by the jet is expressed by the relationship $$F=C\cdot V\alpha l \quad (1<\alpha<2)$$

where V is the relative velocity of the jet to the running yarn, 1 is the length of the yarn under this relative velocity; and C is a change factor.

Thus the yarn-suction force F will be proportional to the yarn length. In other words, it will be proportional to the length of the jet flow at the velocity V. Accordingly an increased length of the discharge pipe 13 will lead to an increase in the yarn-suction force F. The effect will be greater especially when the value of Lm of the narrowest portion 13*a* of the discharge pipe 13 which makes the most contribution to the yarn suction is increased.

It has been found that the contribution to the yarn-suction force F will be prominent when Lm and Dm are in the relation (b).

The discharge hose 14 connected to the rear end of the discharge pipe 13 serves to transport the jet smoothly, while attracting the yarn. The discharge hose 14 and the supply hose 9 are the longest elements of the suction gun 1 and these elements are required to be flexible to facilitate the threading operation. Meanwhile, being one of the longest elements of the suction gun, the discharge hose 14 naturally causes the heaviest fricitional loss to the jet and exerts the greatest back pressure on the jet. Therefore if the bore of the discharge hose 14 is relatively small, a large back pressure will act on the jet which would attract the yarn, greatly reducing the dynamic pressure of the jet and resulting in a weakening of the yarn suction force. Thus the discharge hose 14 also has a limit bore diameter below which an extreme drop in the suction force is caused and this limit, which is related to the jet flow volume, i.e., the total sectional area of the suction nozzles 11, can be expressed by the formula (c) mentioned above.

The highest efficiency of yarn suction will be obtained when the bore diameter Dh of the discharge hose 14 is set in the following range:

$$3 < D_h/(\sqrt{n}\cdot d) < 4.5$$

Suction of a running yarn into the suction gun 1 through the yarn-guide hole 3*a* is attributable to the ejector effect of a jet issuing from the suction nozzle 11 which produces a negative pressure, which suckes the air, entraining the yarn. This yarn suction will now be described.

The ejector effect of the nozzle jet drawing the air depends, in a greatest measure, upon the velocity and volume of the jet flow but in terms of the suction gun, the following two factors exert a considerable influence.

The first factor is the positional relation between the rear end of the yarn-guide pipe 3 and the exit 11*a* of the nozzle 11. Namely, since the effect of a jet issuing from the suction nozzle 11 is such that the jet comes out together with the surrounding air and as a consequence it creates a negative pressure around itself, it is necessary for the purpose of drawing more air through the yarn-guide hole 3*a*, that the rear end of the yarn-guide pipe 3 communicating with the yarn-guide hole 3*a* be brought closer to the exit 11*a* of the suction nozzle 11. This can be effectively accomplished by setting the rear end of the yarn-guide pipe 3 beyond the exit 11*a* of the suction nozzle 11, i.e., to the side of the yarn-guide hole 3*a*, thereby making the exit 11*a* closer to the axial extension of the discharge pipe 13.

The second factor is the bore inner diameter of the yarn guide pipe 3. The smaller the bore for the same flow rate, the faster will be the flow of the air drawn through the yarn-guide pipe 3. Too small a bore, however, will weaken the initial suction, leading to a failure of yarn attraction. Meanwhile the volume of air suction affects the yarn suction within the discharge pipe 13. Considering these conditions, it is desirable to constitute the system such that the following relation exists:

$$0.5D_m<D_s<1.5D_m$$

where $D_s$ is the bore diameter of the yarn-guide pipe 3 and $D_m$ is the bore diameter of the narrowest portion 13*a* of the discharge pipe 13.

Figure 8:
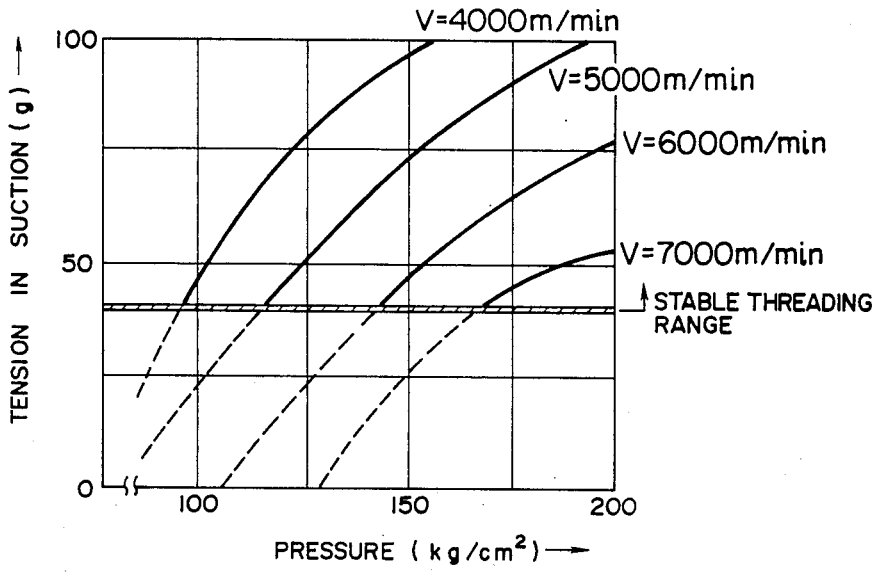
FIG. 8 is a graph showing the relationship between the pressure of the working pressurized water and the tension developed in a yarn at each yarn speed.
Figure 9:
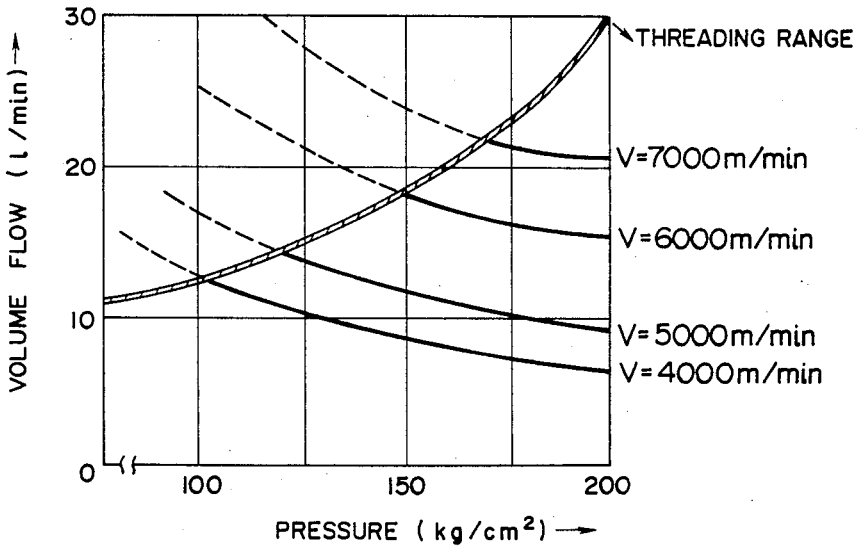
FIG. 9 is a graph showing the relationship between the pressure and the flow volume at each yarn speed.

Using a device illustrated in FIG. 1, the relation between the fluid pressure P and the flow volume Q under which a running yarn of the speed $V_0$ can be turned round and threaded on the winder has been experimentally studied, yielding the results as depicted in FIGS. 8 and 9. Thus the above relation has been established in terms of the attractive tension T vs. P and Q.

FIGS. 8 and 9 summarize the results of a threading experiment of a yarn of nylon filament 70D-24 at a yarn running speed of 4,000 m/min.–7,000 m/min.

FIG. 8 graphically shows the relation between the pressure of the working pressurized water and the tension developed in the yarn at each yarn speed. Development of more than about 40 g tension in this yarn of 70 denier will ensure stable threading, and the necessary pressure at each yarn speed will be known. Experimental $C_D$ values have been known.

FIG. 9 graphically shows the relation between the pressure and the flow volume at each yarn speed.

From these relations the necessary power (pressure×flow volume) to drive the high-pressure pump to supply the pressurized water for threading the yarn at each speed can be determined.

With the elements of the suction gun 1 designed in the shape and dimensions specified above, four moving yarns of 70D-24f nylon 6 filament were attracted at a speed of 5,500 m/min. and the tension T developed per one yarn was measured with the results listed below. The threading suction gun 1 employed thereby was the one illustrated in FIG. 1 and the high-pressure pump employed was one with a 15 kwH capacity. The pressure of the working fluid was set at 180 kg/cm$^2$G.

TABLE

| TEST No. | FIXED CONDITION (1) $\theta$ | (2) n | (2) d (MM) | (2) $D_m$ (MM) | 3 $L_m$ | (4) $D_h$ (MM) | EXAMPLE, CONTRAST VARIABLE CONDITION TENSION | | | |
|---|---|---|---|---|---|---|---|---|---|---|
| I | 10° | 4 | 1 | 3 | 150 | 8 | T = 80 g | | | |
| II | | 4 | 1 | 3 | 150 | 8 | $\theta$ = 20° T = 72 g CONTRAST | $\theta$ = 30° T = 52 g | $\theta$ = 45° T = 37 g | CONTRAST $\theta$ = 50° T = 30 g CONSTRAST |
| III | 10° | 4 | 1 | | 150 | 8 | $D_m$ = 2.2 REVERSE FLOW CONTRAST | $D_m$ = 4 T = 76 g | $D_m$ = 6 T = 57 g | $D_m$ = 9.5 T = 34 g CONTRAST |
| IV | 10° | | | 3 | 150 | 8 | n = 3, d = 1.5 REVERSE FLOW CONTRAST | n = 3, d = 1 T = 68 g | | n = 6, d = 0.5 T = 24 g |
| V | 10° | 4 | 1 | 3 | 150 | | $L_m$ = 50 T = 32 g CONTRAST | $L_m$ = 100 T = 57 g | $L_m$ = 200 T = 84 g | $L_m$ = 280 T = 87 g |
| VI | 10° | 4 | 1 | 3 | 150 | | $D_h$ = 3.5 REVERSE FLOW | $D_h$ = 5.5 T = 64 g | $D_h$ = 10 T = 78 g | $D_h$ = 14 T = 67 g |

In the above Table, all of the examples except those specified as comparative examples are embodiments of the present invention. As seen from the Table, only when the constitution according to the present invention is adopted, can a tension T=40 (g), which ensures stable turn around and threading of the yarn, be secured.

Figure 10:
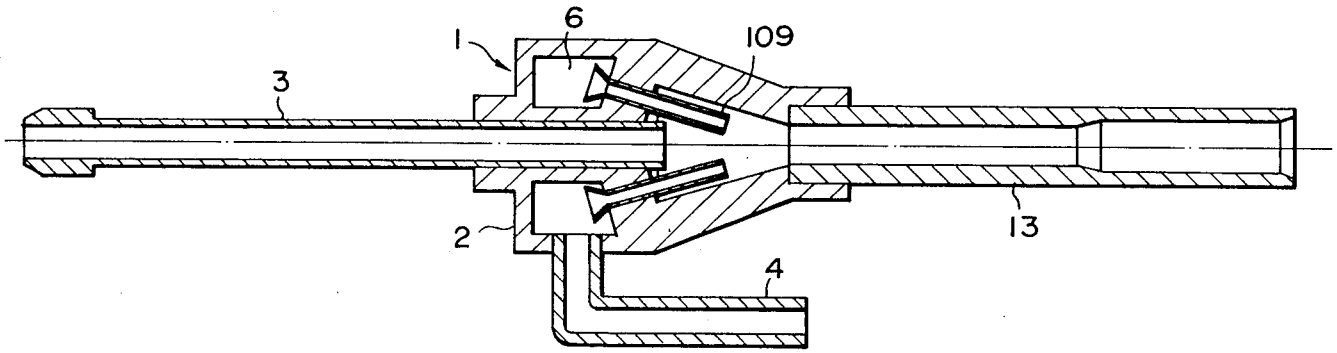
FIG. 10 is a sectional view of a suction gun with a tube according to another embodiment of the yarn-threading device of the present invention.

For better performance, the suction nozzle 11 may be designed as illustrated in FIG. 10. The suction nozzle 11 in FIG. 10 is equipped with a tube 109 inserted at the bored position. The other details are the same as in FIG. 1.

Next, auxiliary mechanisms for yarn attraction in the suction gun 1 which can be used in connection with the present invention are described. These auxiliary mechanisms are utilized to increase the yarn attraction of the suction nozzle 11 alone.

Available mechanisms include:

(1) A mechanism to convey the yarn by means of a pressurized liquid from the yarn-guide hole 3*a* of the yarn-guide pipe 3 up to the suction mechanism consisting of the suction nozzle 11;

(2) A mechanism to covey the yarn by means of, say, a thrust guide from the yarn-guide hole 3*a* of the yarn-guide pipe 3 to the suction mechanism by the suction nozzle 11;

(3) A mechanism to convey the yarn by means of a pull-in device installed in the yarn-guide pipe 3 up to the suction mechanism consisting of the suction nozzle 11; and (4) A mechanism to convey the yarn by a pressurized air ejector installed at the front tip of the yarn-guide pipe 3, through the yarn-guide pipe 3 up to the suction mechanism consisting of the suction nozzle 11.

Figure 11:
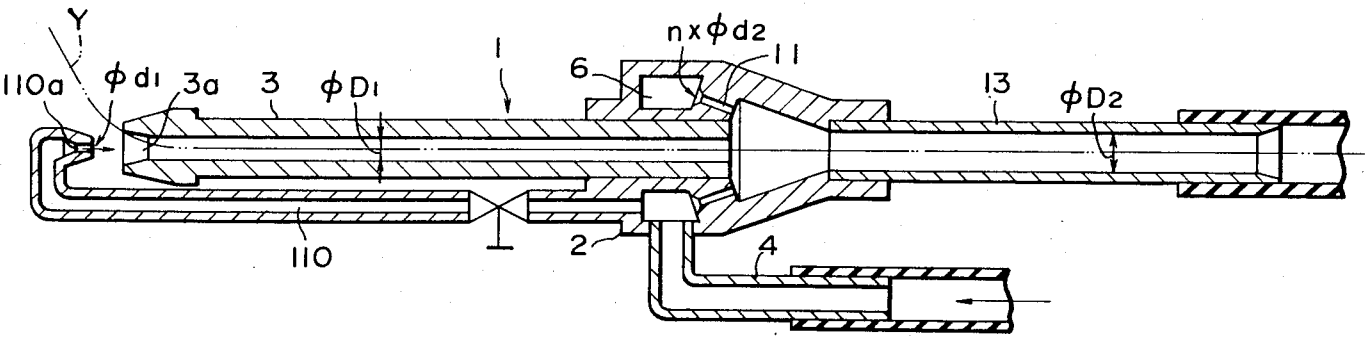
FIG. 11 is a sectional view of a suction gun with a yarn-attraction nozzle according to another embodiment of the yarn-threading device of the present invention.

First the mechanism (1) will be described. As shown in FIG. 11, the suction gun 1 in this mechanism comprises the yarn-attraction nozzle 110, out of which issues a jet into the yarn-guide hole 3*a* opening at the tip of the yarn-guide pipe 3, and suction nozzles 11, not less than two of which are installed around the rear end of the yarn-guide pipe 3. A discharge pipe 13 is provided for discharging the yarn drawn by the jet through the yarn-guide pipe 3 together with the jet, the discharge pipe being connected to the rear end of the gun body 2.

Figure 12:
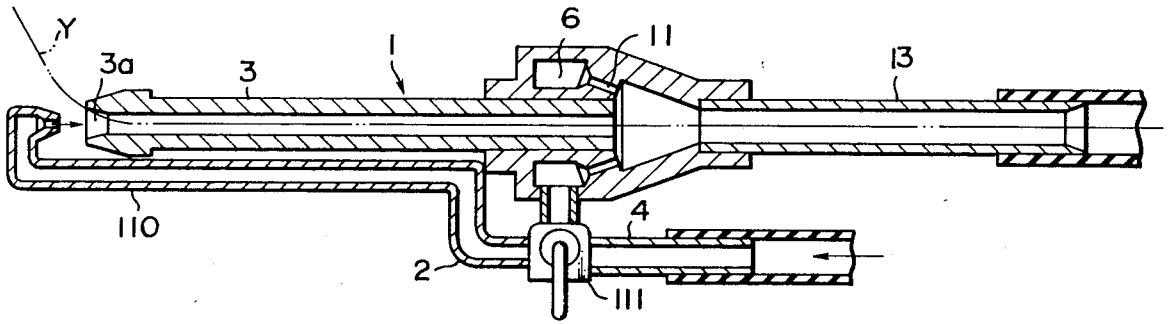
FIG. 12 is a sectional view of a suction gun with a valve at a branch-off point of the paths to the yarn-attraction nozzle and the suction nozzle according to another embodiment of the yarn-threading device of the present invention.

As indicated in FIG. 12, fluid supply to the yarn-attraction nozzle 110 and to the suction nozzle 11 may be separately accomplished. In the example of FIG. 12, a three-way valve 111 for the on-off introduction of the fluid into the nozzle 11 or 110 is installed at the branch-off point of the paths to the nozzles 11 and 110.

In the suction gun 1 of FIG. 11, the relationship between the diameter $d_1$ of the yarn-attraction nozzle 110, the diameter $D_1$ of the yarn-guide pipe 3 set opposite to said nozzle 110, the number n and diameter $d_2$ of the suction nozzles 11 surrounding the rear end of the yarn-guide pipe 3 and the diameter $D_2$ of the discharge pipe 13 to discharge a converging flow of the jet from the yarn-guide pipe 3 and the jet from the suction nozzle 11 are established as follows;

$$d_1 < d_2\sqrt{n} \quad \text{(a)}$$

$$D_1 < D_2 \quad \text{(b)}$$

Figure 13:
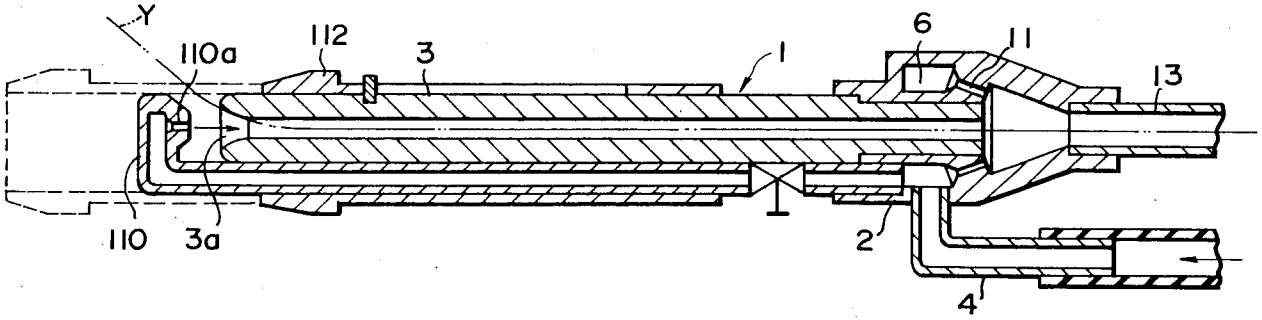
FIG. 13 is a sectional view of a suction gun with a yarn position control member according to another embodiment of a yarn-threading device of the present invention.
Figure 14:
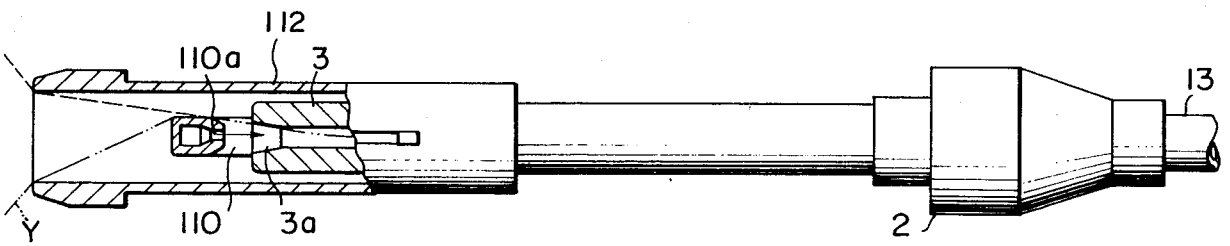
FIG. 14 is a sectional view of the suction gun of FIG. 13 with the yarn position control member pushed in a forward position.

The suction gun 1, provided with a yarn-attraction nozzle 110, may be constituted as illustrated in FIGS. 13 and 14 to prevent the yarn Y from entangling at the yarn-attraction nozzle 110 in the Nelson threading of the godet roller. The suction gun 1 in FIGS. 13 and 14 comprises the yarn-attraction nozzle 110 which ejects the liquid through its ejection hole 110*a* installed at the head of a slender supply pipe, and the yarn-guide pipe 3 which guides the liquid and the yarn carried in the liquid, with a spacing set between ejection hole 110*a* of the yarn-attraction nozzle 110 and the yarn-guide hole 3*a* of the yarn-guide pipe 3. There is also provided a yarn-position control member 112 slidably disposed with respect to the yarn-guide pipe 3 so that the angle at which the yarn Y is introduced into the yarn guide pipe 3 through the yarn-guide hole 3*a* can be shifted in position to make the yarn bend at a substantially forward position relative to the top of the head of the slender supply pipe 110. When the yarn is drawn in, the yarn-position control member 112 is slid rear-ward to the position of FIG. 13 shown in full line. When a roller is to be threaded, the member 112 is slid forward to the position shown in FIG. 14. In this way even when Nelson threading is made, entanglement of the yarn at the yarn-attraction nozzle 110 can be avoided.

Figure 15:
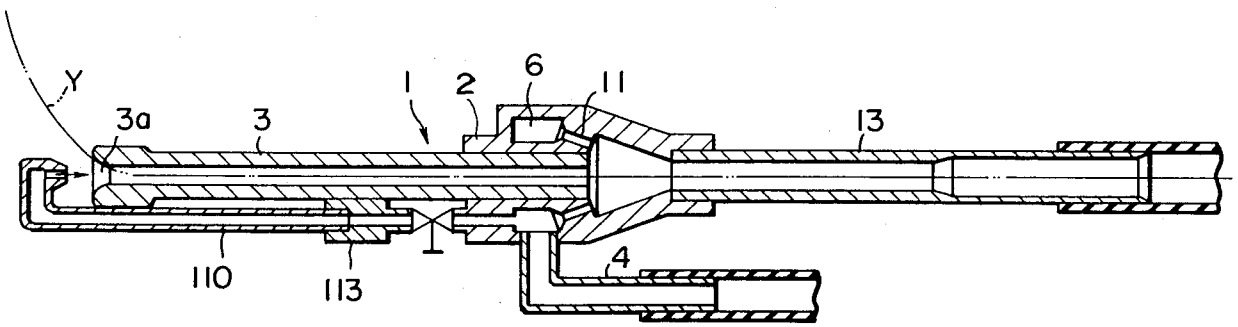
FIG. 15 is a sectional view of a suction gun with a yarn attraction nozzle detachable from a gun body according to another embodiment of the yarn-threading device of the present invention.

For the same purpose of preventing a yarn entanglement at the nozzle 110, a one-touch coupler 113, as shown in FIG. 15, can be installed midway toward the yarn-attraction nozzle 110 to make the nozzle 110 detachable from the yarn-guide pipe 3 and the suction gun body 2. In this manner entanglement of the yarn Y at the yarn-attraction nozzle 110 in the Nelson threading can be avoided by simply uncoupling the nozzle 110 at the coupler 113.

Figure 16:
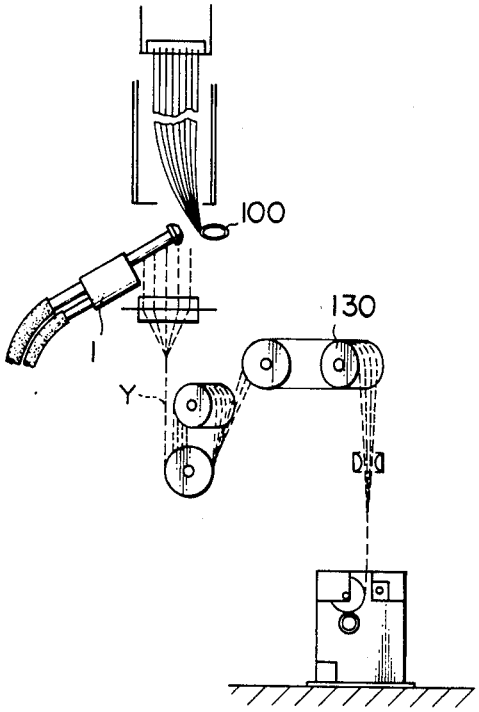
FIG. 16 is an elevational view of a yarn-threading device with Nelson rollers according to the present invention.

FIG. 16 illustrates a Nelson threading operation. The operation may be done with only two godet rollers 34,35 shown in FIG. 2 as well as with a plurality of paired godet rollers 130, for example with multiple Nelson rollers In the latter case the yarn Y is wound in several turns on a number of paired godet rollers and when the suction gun 1 is equipped with a yarn- attraction nozzle 110 as shown in FIGS. 11 to 13, 15 or FIG. 24, the yarn Y to be attracted will be entangled to the nozzle head. To prevent this entanglement, the yarn-position control member 112 illustrated in FIGS. 13 and 14 or the coupler 113 in FIG. 15 is employed.

Figure 18:
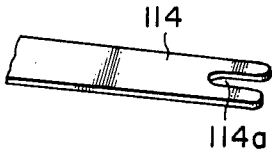
FIG. 18 is a perspective view of an end portion of the thrust rod of FIG. 17.
Figure 17:
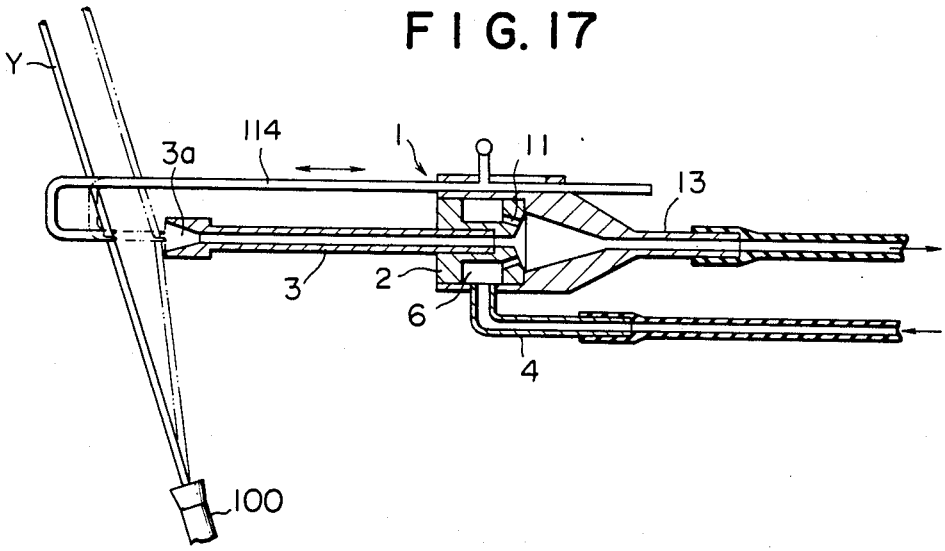
FIG. 17 is a sectional view of one portion of a suction gun with a thrust rod according to another embodiment of the yarn-threading device of the present invention.

Next the auxiliary mechanism (2) will be described. The suction gun 1 equipped with this mechanism is illustrated in FIG. 17, in which a yarn running close to the yarn-guide hole 3*a* is attracted and taken in by the attraction mechanism which comprises a thrust rod 114 installed near the yarn-guide hole 3*a* for forcibly thrusting the yarn Y into the yarn guide hole 3*a* of the yarn-guide pipe 3. The suction gun 1 has a suction mechanism produced by the high-pressure liquid jet. As shown in FIG. 18 the thrust device consists of a thrust rod 114 provided with a groove 114*a* at the tip end thereof to hold the yarn Y.

The thrust rod 114 is slidably attached to the gun body 2 of the suction gun 1. The thrust rod 114 may be designed to be detachable from the gun body 2, for the purpose of preventing the yarn from becoming entangled around the thrust rod 114 in the Nelson threading.

Figure 19:
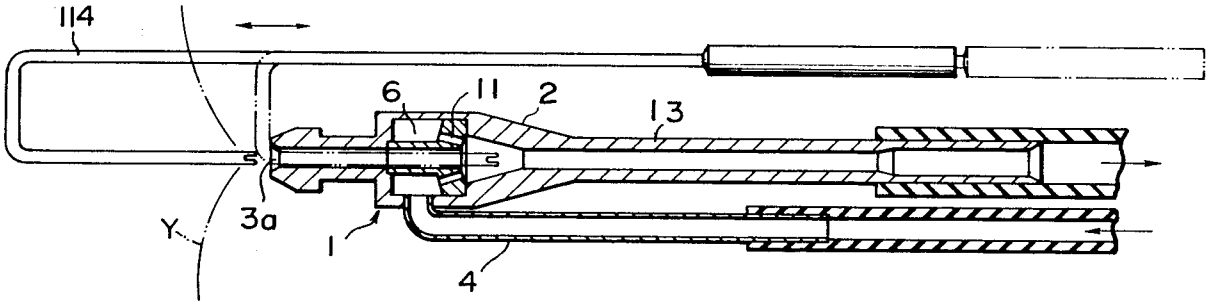
FIG. 19 is a sectional view of a suction gun with a thrust rod, the end portion of which can be inserted up to a suction nozzle, according to another embodiment of the yarn-threading device of the present invention.

The suction gun 1 may be constructed, as shown in FIG. 19, such that the thrust rod 114 can slide after it catches the running yarn, until it comes into contact with the jet from the suction nozzle 11 within the gun body 2, thereby ensuring the suction of the yarn.

Figure 20:
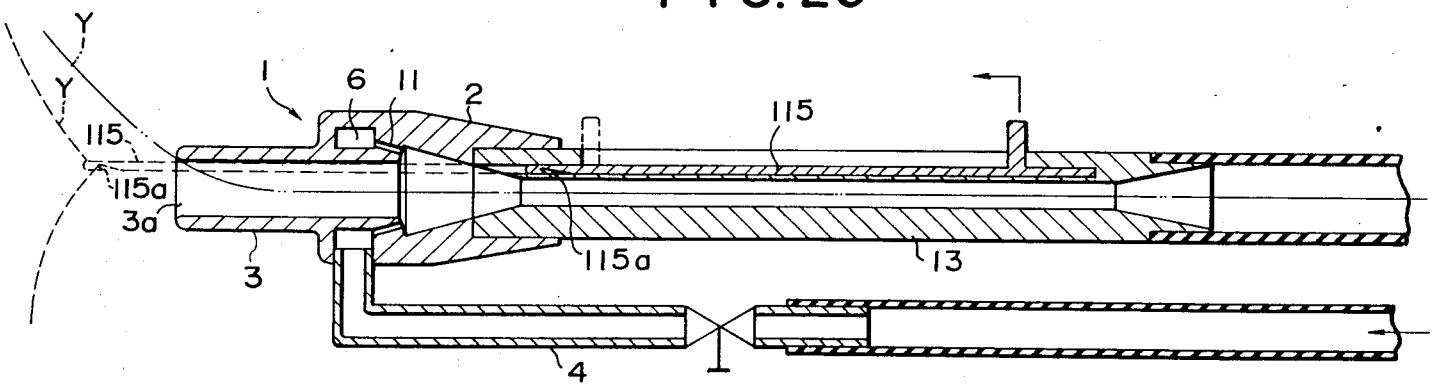
FIG. 20 is a sectional view of a suction gun with a yarn-catching member according to another embodiment of the yarn-threading device of the present invention.

Next the auxiliary mechanism (3) will be described. As indicated in FIG. 20, the suction gun 1 equipped with the mechanism (3) comprises a gun body 2 which has the suction nozzle 11 to draw the yarn Y running close to the yarn guide hole 3*a* of the yarn-guide pipe 3 by means of a pressurized liquid, a discharge pipe 13 which is connected to the rear end of the gun body 2 to discharge the drawn yarn together with the pressurized liquid, and a yarn-catching member 115 to catch and forcibly pull the yarn which is slidably installed in the axial direction of suction gun, on the surface of the wall or in the wall of the discharge pipe 13. At the tip of the yarn-catching member 115 is formed a hook-like recess 115*a* to catch the yarn Y.

Figure 21:
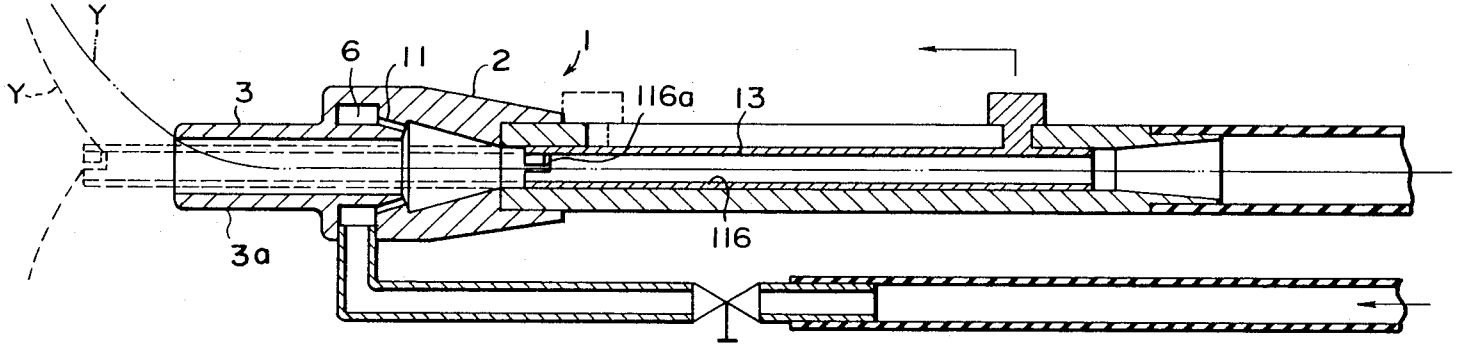
FIG. 21 is a sectional view of a suction gun with a yarn-catching member having a cutter mechanism according to another embodiment of the yarn-threading device of the present invention.
Figure 22:
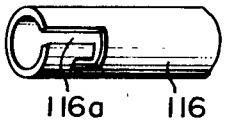
FIG. 22 is a perspective view of the yarn-catching member of FIG. 21.
Figure 23:
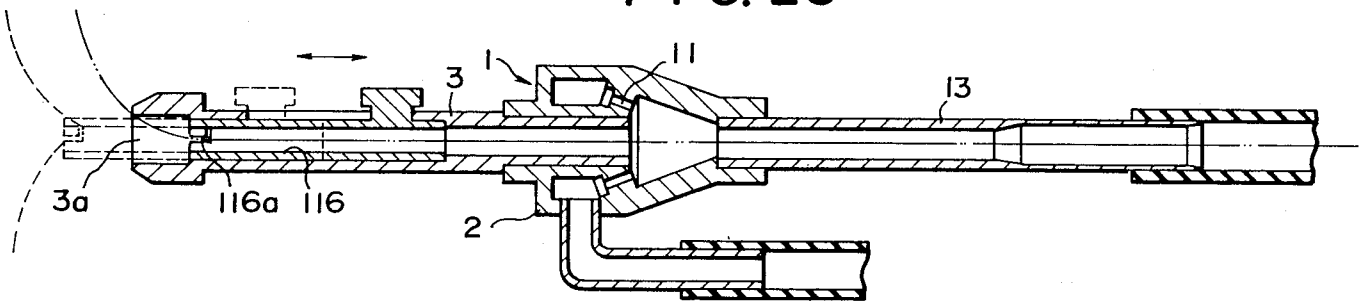
FIG. 23 is a sectional view of a suction gun equipped with a yarn-catching member within a yarn-guide pipe according to another embodiment of a yarn-threading device of the present invention.

The suction gun 1 equipped with the mechanism 3 may be otherwise constituted as shown in FIGS. 21, 22 and 23. Namely, it may comprise the gun body 2 which has the suction mechanism to draw the yarn Y running close to the yarn-guide hole 3*a* through the yarn-guide pipe 3 by means of a pressurized liquid, a discharge pipe 13 which is connected to the rear end of the gun body 2 to discharge the drawn yarn together with the pressurized liquid, and a yarn-catching member 116 for catching the yarn by forcibly pulling it, including a cutter-equipped tube which is slidably installed on the inside wall of the yarn-guide pipe 3. At the tip of the tube 116 is formed a yarn-hook 116*a*. In this case, the yarn Y is cut by a thrust of the inner surface of the yarn guide pipe 3 and the outer surface of the cutter-equipped tube 116, when the tube 116 is taken into the yarn guide pipe 3.

In the embodiment of FIG. 21 the tube 116 is inserted up to the discharge pipe 13, while in the embodiment of FIG. 23 the tube 116 is inserted up to the yarn-guide pipe 3.

Figure 24:
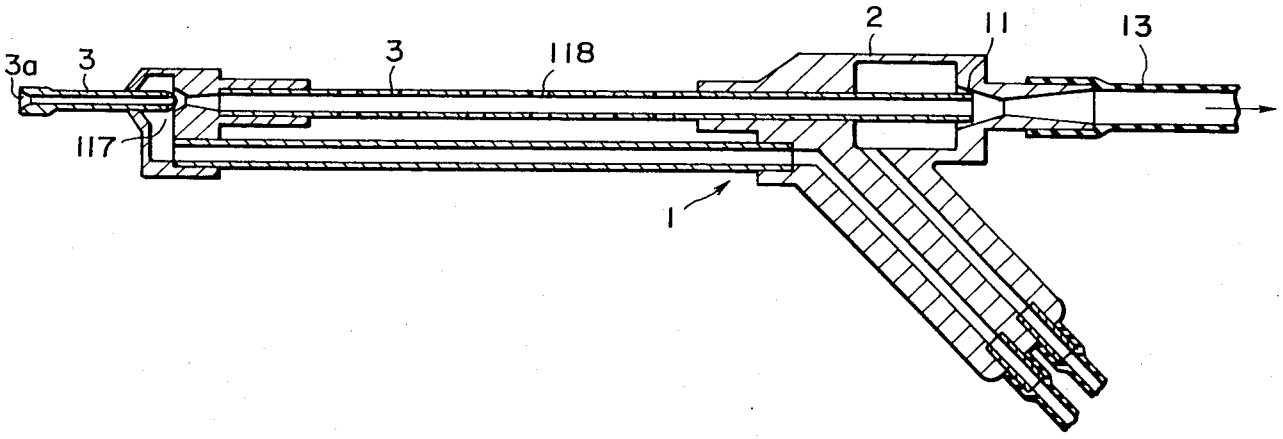
FIG. 24 is a sectional view of a suction gun with a compressed air jet nozzle according to another embodiment of a yarn-threading device of the present invention.

Next the auxiliary mechanism (4) will be described. As shown in FIG. 24, the suction gun 1 equipped with the mechanism (4) comprises the gun body 2 with a suction mechanism 11 to draw the yarn running close to the yarn-guide hole 3*a* into the hole 3*a* of the yarn-guide pipe 3 by means of a pressurized liquid jet. The discharge pipe 13 is connected to the rear end of the gun body 2 to discharge the drawn yarn together with the pressurized liquid, and a compressed air jet nozzle 117 is provided near the yarn-guide hole 3*a* for forcibly attracting the yarn running close to the yarn-guide hole 3*a*. In this case the yarn-guide pipe 3 is provided with a plurality of bored orifices 118 to prevent an increase of the back pressure of the air. Thus under an ejector effect of compressed air issuing from the nozzle 117, the yarn is drawn into the yarn-guide pipe 3 and conveyed to the fluid-attraction mechanism.

Next another embodiment of the suction gun 1 is described. The suction gun illustrated in FIG. 25 has only a fluid jet nozzle 119 and no suction mechanism by the suction nozzle.

Figure 25:
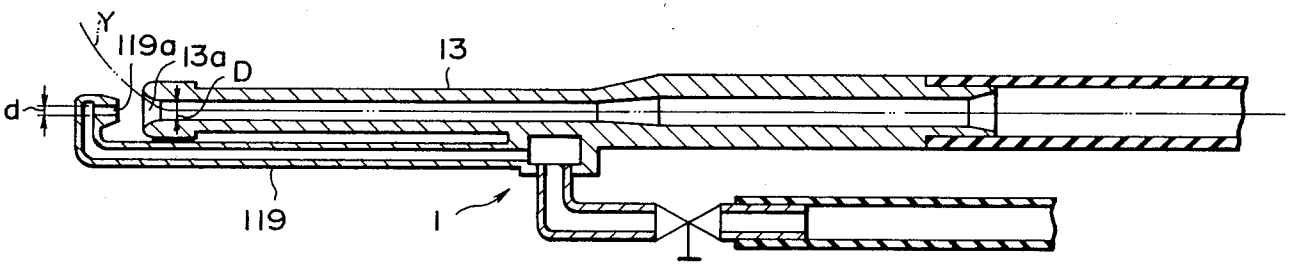
FIG. 25 is a sectional view of a suction gun with a fluid ejection nozzle according to another embodiment of a yarn-threading device of the present invention.

The suction gun 1 illustrated in FIG. 25 consists of a fluid ejection nozzle 119 to eject a liquid and a discharge pipe 13 to discharge the yarn together with the liquid. The ejection hole 119*a* of the fluid ejection nozzle 119 and the entrance 13*a* to the discharge pipe 13 are spacedly opposed to each other. When the liquid is a pressurized liquid of not less than 80 $kg/cm^2G$, the relationship between the bore diameter (d) of the ejection hole 119*a* and the bore diameter (D) of the discharge pipe 13 should satisfy the following condition.

$$1.25 \times d < D < 4.5 \times d.$$

Figure 26:
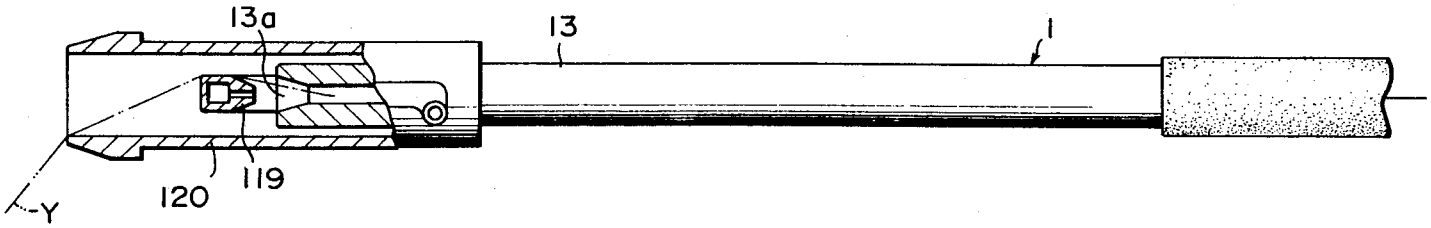
FIG. 26 is a sectional view of a suction gun with a yarn position control member according to another embodiment of a yarn-threading device of the present invention.

In Nelson threading using the suction gun 1 of FIG. 25, it is desirable to install a yarn position control member consisting of a sleeve 120, as illustrated in FIG. 26, slidably provided on the discharge pipe 13 so that an entanglement of the yarn Y around the nozzle 119 can be avoided. In the Nelson threading using the suction gun 1 of FIG. 26, when the yarn is drawn into the discharge pipe 13, the sleeve 120 is receded, whereas, when the yarn is threaded on the Nelson rollers, the sleeve 120 is pushed forward as shown in FIG. 26. In this manner an entanglement of the yarn around the nozzle 119 can be prevented.

Figure 27:
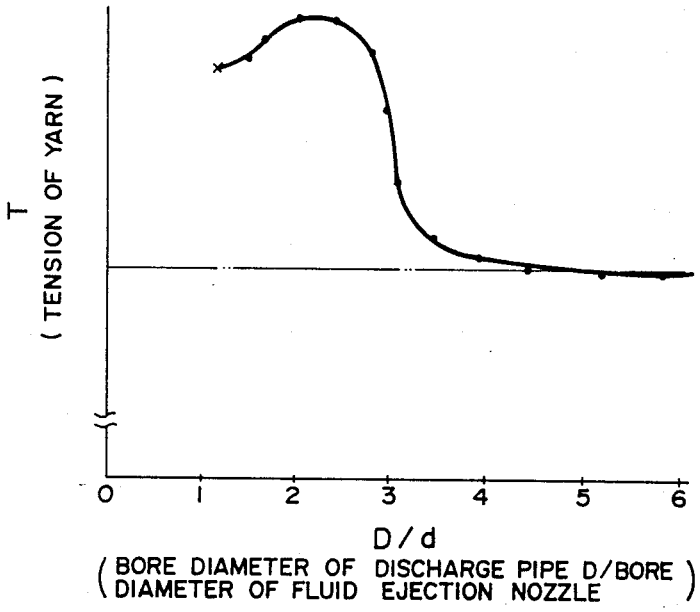
FIG. 27 is a graph showing the relationship between (a bore diameter of a discharge pipe/a bore diameter of a fluid ejection nozzle) and the tension of the yarn.

FIG. 27 is a diagram showing the relationship between the bore diameter D of the discharge pipe 13, the bore diameter d of the fluid ejection nozzle 119 and the tension T of the attracted yarn Y in the suction gun 1 of FIG. 25 with an extremely simple construction according to the present invention.

As seen from FIG. 27, a strong tension T is created on the yarn Y when the following relation is satisfied;

$$1.25 \times d < D < 4.5 \times d$$

and in particular when $1.8 \times d < D < 3.2 \times d$ is satisfied, the highest efficiency of attraction is exhibited.

When the above conditions are satisfied, the yarn Y running at a high speed can be reliably attracted to the yarn-guide hole 13*a* by a jet issuing from the nozzle 119 and on account of the great kinematic energy of the jet the yarn is thrust together with the pressurized liquid into the discharge pipe 3 and is transfered via a discharge hose to a waste disposal tank.

Next, referring to FIGS. 28 to 31, the yarn threading process and device using the suction gun 1 are described. The process takes place as follows: A yarn Y being wound on a winder 121 at a rate not slower than 4,500 m/min. is drawn into the suction hole of the suction gun 1 to which is being supplied a pressurized liquid of not less than 80 $kg/cm_2G$, and while the yarn Y is being drawn, the winder bobbin 122 is replaced with an empty bobbin. After the empty bobbin attains a specified peripheral speed, the yarn Y drawn into the suction gun 1 is threaded on said empty bobbin 122.

The threading operation can be achieved by using a movable suction gun 1. Alternatively, it may be arranged such that the yarn attraction is achieved by means of a stationary suction gun 1 fixed near the winder 121 and the threading on the empty bobbin 122 is achieved by means of a movable guide 123 as shown in FIGS. 28 and 29.

The threading device to be employed in the above process is a suction gun 1 consisting of a suction mechanism using a pressurized liquid jet, said gun being located near the winder 121.

Figure 30:
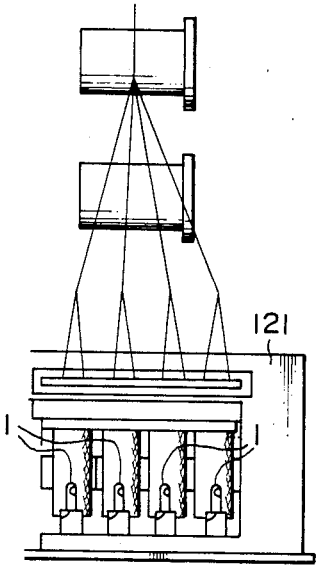
FIG. 30 is an elevational view of another yarn-threading device with a plurality of yarns according to the present invention.

Another embodiment as illustrated in FIG. 30 is possible in which as many suction guns 1 as the number of the yarns to be wound on the winder 121 are utilized.

Figure 28:
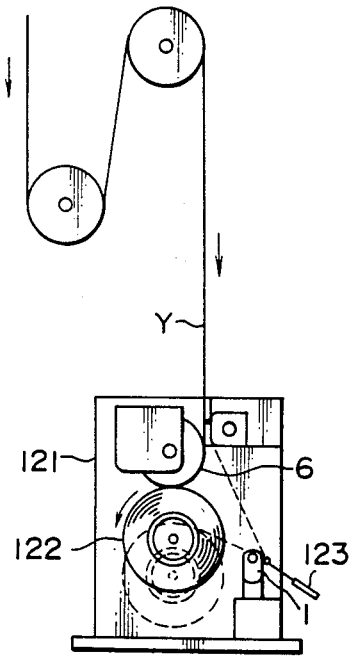
FIG. 28 is an elevational view of another yarn-threading device according to the present invention.
Figure 29:
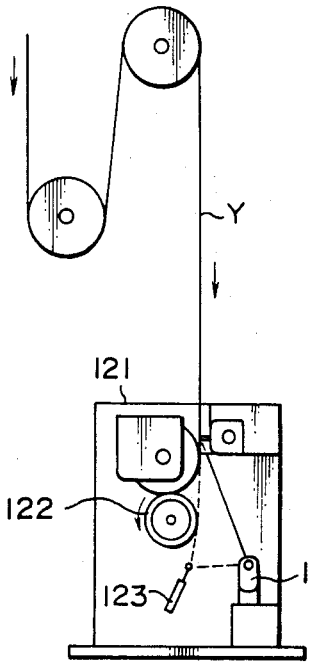
FIG. 29 is an elevational view of the yarn-threading device of FIG. 28 showing threading onto an empty bobbin.

There are still other embodiments as illustrated in FIGS. 28 and 29, in which a movable guide 123 to guide the yarn Y to the yarn-guide hole of the suction gun 1 is installed. As shown in FIG. 29, the movable guide 123 guides the running yarn Y attracted to the suction gun 1 to an empty bobbin 122 or to the winder 121.

Figure 31:
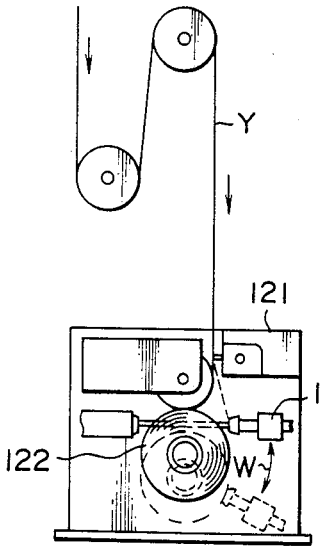
FIG. 31 is an elevational view of another yarn-threading device with a suction gun movable within a specified range according to the present invention.

Furthermore, as indicated in FIG. 31, the suction gun 1 may be designed such that when a bobbin 122 is to be threaded, the suction gun 1 can be shifted within a specified range W around the winder 121.

For the purpose of threading the yarn by means of the above-mentioned device, as illustrated in FIGS. 28 and 29, when the bobbin 122 is full, the yarn Y is picked up by the suction gun 1 or by the guide 123. The yarn is drawn into the yarn-guide hole of the gun 1 by a pressurized liquid, and the yarn Y coming from the godet roller is attracted at a speed faster than the peripheral speed of the godet roller, thereby the yarn is temporarily wasted. Next, the full bobbin is removed and an empty bobbin 122 is placed on the winder 121. Thereafter the empty bobbin 122 is rotated to attain a specified peripheral speed.

Thereupon, the running yarn attracted to the suction gun 1 is brought up to the empty bobbin 122 for threading. In threading, the guide 123 may serve to guide the running yarn to the empty rotating bobbin 122. When the threading is finished, the supply of the pressurized liquid to the suction gun 1 is stopped.

Figure 32:
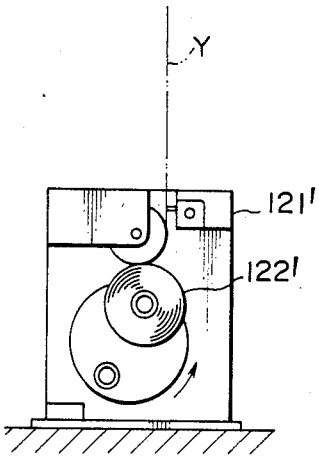
FIG. 32 is an elevational view of a yarn-threading device for purpose of comparison.

FIG. 32 illustrates a conventional revolving winder 121' as a contrast. This winder has two spindle shafts. The spindles revolve around the center of the shafts and when a bobbin becomes full, the yarn Y is switched to an empty bobbin 122'.

Unlike this device, the device of the present invention needs no additional cost for installation of spindle shafts and thus is more economical.

In the contrasted device, a compressed air suction gun is employed for threading and changing the yarn. The present invention, by using a pressurized liquid suction gun, enables a reliable threading and changing of the yarn at a speed of not less than 4,500 m/min. and reduces the running cost to less than $\frac{1}{3}$ of that when utilizing a compressed air system.

What is claimed is:

1. A yarn-threading apparatus in combination with a dewatering device comprising:

means for engaging a yarn-threading apparatus including a suction gun designed, sized and dimensioned to be fed with a pressurized liquid jet of not less than 80 $kg./cm^2G$ as a working fluid for attracting and guiding yarn into a yarn guide hole of said suction gun, which is designed, sized and dimensioned such that it can cause yarn attracted and guided to run at a speed of greater than 4500 meters per minute; and means for dewatering waste yarn produced by said yarn-threading apparatus.

2. The yarn-threading apparatus in combination with a dewatering device of claim 1, wherein said means for engaging a yarn-threading apparatus further includes a means for leading said waste yarn and said liquid to said dewatering means.

3. The yarn-threading apparatus in combination with a dewatering device of claim 1, wherein said dewatering means comprises a waste disposasl tank for separating said waste yarn from said liquid which are simutlaneously discharged from said suction gun.

4. The yarn-threading apparatus in combination with a dewatering device of claim 3, further including a storage tank for storing said separated liquid, and a high-pressure pump for supplying to said suction gun said liquid pressurized to not less than 80 $kg./cm^2G$.

5. The yarn-threading apparatus in combination with a dewatering device of claim 4, wherein said high-pressure pump and said waste disposal tank are mounted on a movable truck.

6. The yarn-threading apparatus in combination with a dewatering device of claim 3, wherein said waste disposal tank is designed for both holding and dewatering of said waste yarn.

7. The yarn-threading apparatus in combination with a dewatering device of claim 6, wherein said dewatering is achieved by a centrifugal dewatering machine.

8. The yarn-threading apparatus in combination with a dewatering device of claim 6, wherein said dewatering is achieved by squeezing with compression plates.

9. The yarn-threading apparatus in combination with a dewatering device of claim 6, wherein said dewatering is achieved by screw squeezing.

* * * * *